US010472974B2

(12) United States Patent
Jones et al.

(10) Patent No.: US 10,472,974 B2
(45) Date of Patent: Nov. 12, 2019

(54) TURBOMACHINE ROTOR BLADE

(71) Applicant: General Electric Company, Schenectady, NY (US)

(72) Inventors: Mark Andrew Jones, Ponte Vedra Beach, FL (US); James Tyson Balkcum, III, Taylors, SC (US)

(73) Assignee: General Electric Company, Schenectady, NY (US)

( * ) Notice: Subject to any disclaimer, the term of this patent is extended or adjusted under 35 U.S.C. 154(b) by 198 days.

(21) Appl. No.: 15/432,117

(22) Filed: Feb. 14, 2017

(65) Prior Publication Data

US 2018/0230813 A1 Aug. 16, 2018

(51) Int. Cl.
*F01D 5/18* (2006.01)
*F01D 5/22* (2006.01)

(52) U.S. Cl.
CPC ..... *F01D 5/187* (2013.01); *F01D 5/225* (2013.01); *F05D 2240/301* (2013.01); *F05D 2240/307* (2013.01); *F05D 2260/22141* (2013.01)

(58) Field of Classification Search
CPC . F01D 5/187; F01D 5/188; F01D 5/20; F01D 11/04; F01D 11/08; F01D 11/10; F05D 2240/301; F05D 2240/307; F05D 2260/201
See application file for complete search history.

(56) References Cited

U.S. PATENT DOCUMENTS

| | | | | |
|---|---|---|---|---|
| 3,527,544 | A * | 9/1970 | Allen | F01D 5/187 416/191 |
| 5,322,599 | A * | 6/1994 | Peters | B23H 3/02 205/644 |
| 6,499,950 | B2 | 12/2002 | Willett et al. | |
| 7,066,713 | B2 | 6/2006 | Dube et al. | |
| 7,568,882 | B2 | 8/2009 | Brittingham et al. | |
| 7,686,581 | B2 * | 3/2010 | Brittingham | F01D 5/187 416/97 R |
| 7,946,816 | B2 * | 5/2011 | Brittingham | F01D 5/225 416/189 |
| 7,946,817 | B2 * | 5/2011 | Brittingham | F01D 5/186 416/189 |
| 8,348,612 | B2 * | 1/2013 | Brittingham | F01D 5/225 416/191 |
| 9,127,560 | B2 * | 9/2015 | Collier | F01D 5/187 |
| 9,194,239 | B2 | 11/2015 | Iida | |
| 2011/0255990 | A1 * | 10/2011 | Diamond | F01D 5/20 416/97 R |

OTHER PUBLICATIONS

Fillet_Definition of fillet by Merriam-Webster (Year: 2015).*

* cited by examiner

*Primary Examiner* — David E Sosnowski
*Assistant Examiner* — Maranatha Boardman
(74) *Attorney, Agent, or Firm* — Dority & Manning, P.A.

(57) ABSTRACT

In one aspect, the present disclosure is directed to a rotor blade for a turbomachine. The rotor blade includes an airfoil defining at least one cooling passage. The rotor blade also includes a tip shroud coupled to the airfoil. The tip shroud and the airfoil define a core fluidly coupled to the cooling passage. A maximum radial depth of the core is at least six times greater than a minimum hydraulic diameter of a largest cooling passage of the at least one cooling passage.

16 Claims, 8 Drawing Sheets

TURBOMACHINE ROTOR BLADE

FIELD

The present disclosure generally relates to turbomachines. More particularly, the present disclosure relates to rotor blades for turbomachines.

BACKGROUND

A gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

The turbine section generally includes a plurality of rotor blades. Each rotor blade includes an airfoil positioned within the flow of the combustion gases. In this respect, the rotor blades extract kinetic energy and/or thermal energy from the combustion gases flowing through the turbine section. Certain rotor blades may include a tip shroud coupled to the radially outer end of the airfoil. The tip shroud reduces the amount of combustion gases leaking past the rotor blade. A fillet may transition between the airfoil and the tip shroud.

The rotor blades generally operate in extremely high temperature environments. As such, the airfoils and tip shrouds of rotor blades may define various passages, cavities, and apertures through which cooling fluid may flow. Nevertheless, conventional configurations of the various passages, cavities, and apertures may limit the service life of the rotor blades and require expensive and time consuming manufacturing processes. Furthermore, conventional fillet configurations may also limit the service life of the rotor blades.

BRIEF DESCRIPTION

Aspects and advantages of the technology will be set forth in part in the following description, or may be obvious from the description, or may be learned through practice of the technology.

In one aspect, the present disclosure is directed to a rotor blade for a turbomachine. The rotor blade includes an airfoil defining at least one cooling passage. The rotor blade also includes a tip shroud coupled to the airfoil. The tip shroud and the airfoil define a core fluidly coupled to the cooling passage. A maximum radial depth of the core is at least six times greater than a minimum hydraulic diameter of a largest cooling passage of the at least one cooling passage.

In another aspect, the present disclosure is directed to a rotor blade for a turbomachine. The rotor blade includes an airfoil. The rotor blade also includes a tip shroud coupled to the airfoil. The tip shroud includes a first rib and at least partially defines a cooling core and a central plenum. The first rib defines a first plurality of cross-over apertures fluidly coupling the central plenum and the cooling core. The first plurality of cross-over apertures is arranged in an arcuate pattern.

In a further embodiment, the present disclosure is directed to a rotor blade for a turbomachine. The rotor blade includes an airfoil having a span extending from a root of the airfoil to the tip shroud. The rotor blade also includes a tip shroud coupled to the airfoil, and tip shroud includes a side surface. The tip shroud and the airfoil collectively define a fillet. A runout of the fillet extends beyond the side surface of the tip shroud and/or below ninety percent of the span.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
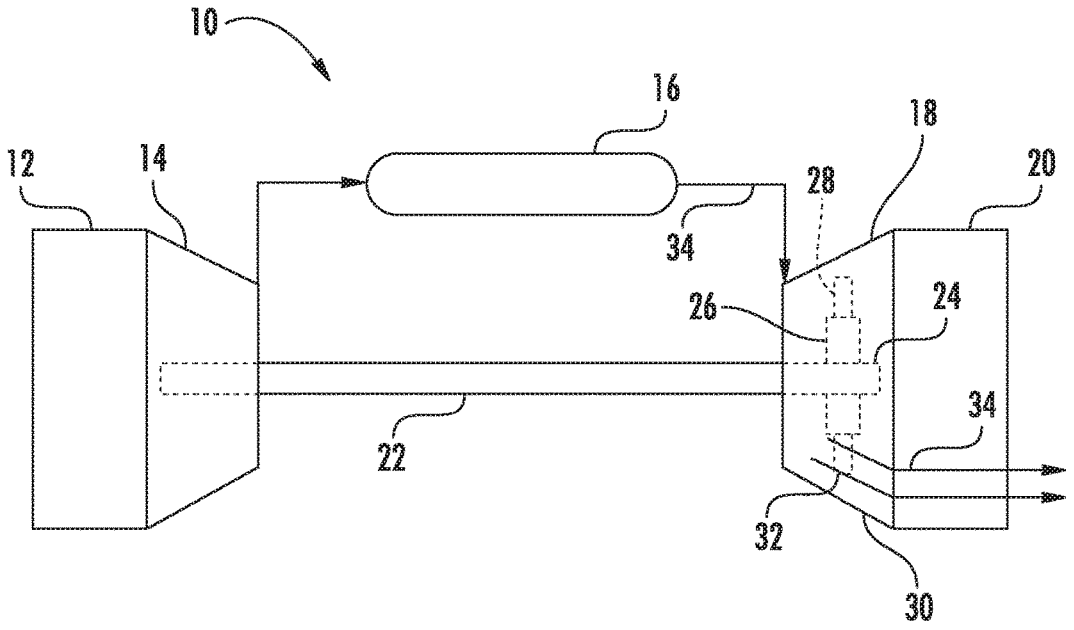
FIG. 1 is a schematic view of an exemplary gas turbine engine in accordance with the embodiments disclosed herein.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. It should be understood that the gas turbine engine 10 of the present disclosure need not be a gas turbine engine, but rather may be any suitable turbomachine, such as a steam turbine engine or other suitable engine. The gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may generally include a rotor shaft 24 having a plurality of rotor disks 26 (one of which is shown) and a plurality of rotor blades 28 extending radially outward from and being interconnected to the rotor disk 26. Each rotor disk 26, in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, air or another working fluid flows through the inlet section 12 and into the compressor section 14, where the air is progressively compressed to provide pressurized air to the combustors (not shown) in the combustion section 16. The pressurized air mixes with fuel and burns within each combustor to produce combustion gases 34. The combustion gases 34 flow along the hot gas path 32 from the combustion section 16 into the turbine section 18. In the turbine section, the rotor blades 28 extract kinetic and/or thermal energy from the combustion gases 34, thereby causing the rotor shaft 24 to rotate. The mechanical rotational energy of the rotor shaft 24 may then be used to power the compressor section 14 and/or to generate electricity. The combustion gases 34 exiting the turbine section 18 may then be exhausted from the gas turbine engine 10 via the exhaust section 20.

Figure 2:
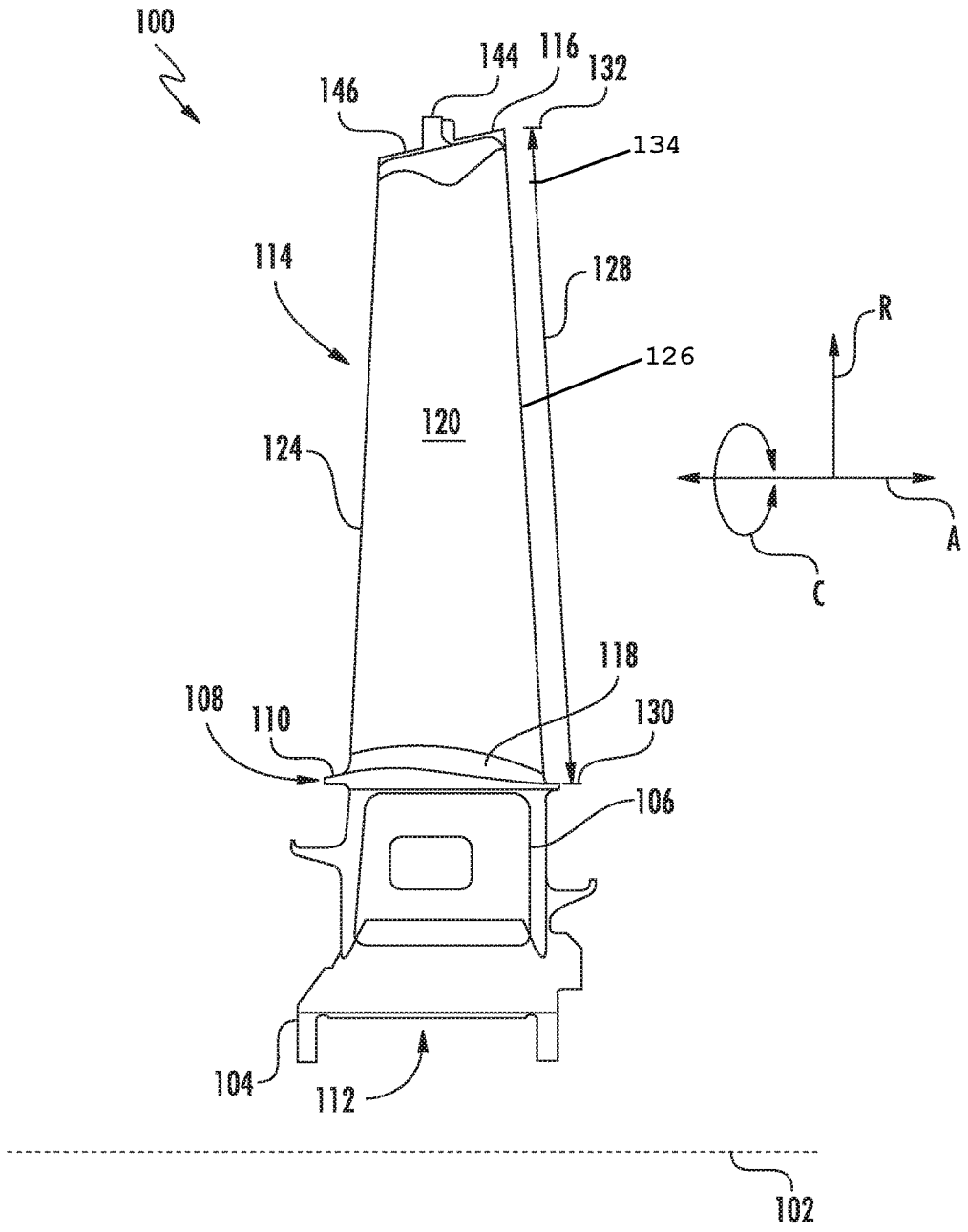
FIG. 2 is a front view of an exemplary rotor blade in accordance with the embodiments disclosed herein.

FIG. 2 is a view of an exemplary rotor blade 100, which may be incorporated into the turbine section 18 of the gas turbine engine 10 in place of the rotor blade 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102. The rotor blade 100 may also be incorporated into the compressor section 14 of the gas turbine engine 10 (FIG. 1).

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, shank portion 106, and platform 108 may define an intake port 112, which permits cooling fluid (e.g., bleed air from the compressor section 14) to enter the rotor blade 100. In the embodiment shown in FIG. 2, the dovetail 104 is an axial entry fir tree-type dovetail. Alternately, the dovetail 104 may be any suitable type of dovetail. In fact, the dovetail 104, shank portion 106, and/or platform 108 may have any suitable configurations.

Figure 3:
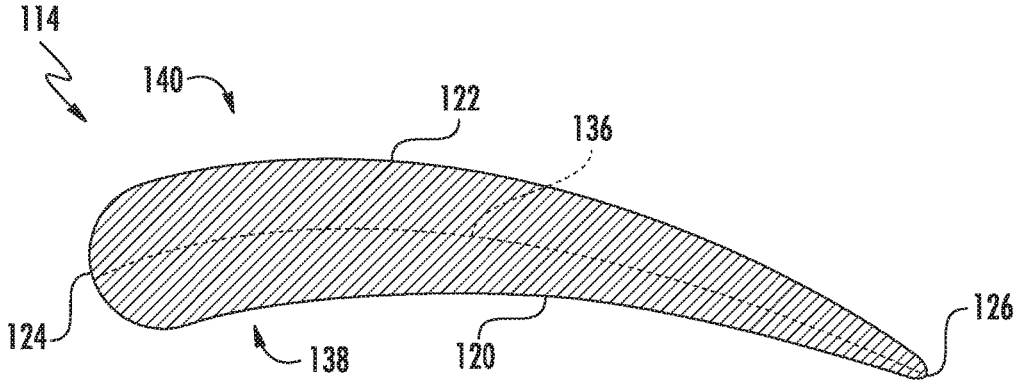
FIG. 3 is a cross-sectional view of an exemplary airfoil in accordance with the embodiments disclosed herein.
Figure 4:
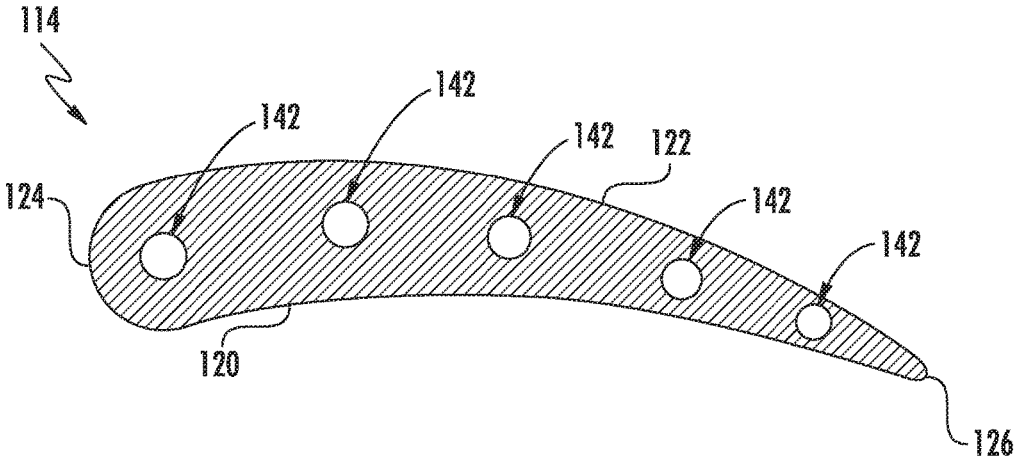
FIG. 4 is an alternate cross-sectional view of the airfoil shown in FIG. 3 in accordance with the embodiments disclosed herein.

Referring now to FIGS. 2-4, the rotor blade 100 further includes an airfoil 114. In particular, the airfoil 114 extends radially outward from the radially outer surface 110 of the platform 108 to a tip shroud 116. In this respect, the airfoil 114 couples to the platform 108 at a root 118 (i.e., the intersection between the airfoil 114 and the platform 108). The airfoil 114 includes a pressure side surface 120 and an opposing suction side surface 122 (FIG. 3). The pressure side surface 120 and the suction side surface 122 are joined together or interconnected at a leading edge 124 of the airfoil 114, which is oriented into the flow of combustion gases 34 (FIG. 1). The pressure side surface 120 and the suction side surface 122 are also joined together or interconnected at a trailing edge 126 of the airfoil 114 spaced downstream from the leading edge 124. The pressure side surface 120 and the suction side surface 122 are continuous about the leading edge 124 and the trailing edge 126. The pressure side surface 120 is generally concave, and the suction side surface 122 is generally convex.

Referring particularly to FIG. 2, the airfoil 114 defines a span 128 extending from the root 118 to the tip shroud 116. In particular, the root 118 is positioned at zero percent of the span 128, and the tip shroud 116 is positioned at one hundred percent of the span 128. As shown in FIG. 2, zero percent of the span 128 is identified by 130, and one hundred percent of the span 128 is identified by 132. Furthermore, ninety percent of the span 126 is identified by 134. Other positions along the span 128 may defined as well.

Referring now to FIG. 3, the airfoil 114 defines a camber line 136. More specifically, the camber line 136 extends from the leading edge 124 to the trailing edge 126. The camber line 136 is also positioned between and equidistant from the pressure side surface 120 and the suction side surface 122. As shown, the airfoil 114 and, more generally, the rotor blade 100 include a pressure side 138 positioned on one side of the camber line 136 and a suction side 140 positioned on the other side of the camber line 136.

As illustrated in FIG. 4, the airfoil 114 may partially define a plurality of cooling passages 142 extending therethrough. In the embodiment shown, the airfoil 114 partially defines five cooling passages 142. In alternate embodiments, however, the airfoil 114 may define more or fewer cooling passages 142. The cooling passages 142 extend radially outward from the intake port 112 through the airfoil 114 to the tip shroud 116. In this respect, cooling fluid may flow through the cooling passages 142 from the intake port 112 to the tip shroud 116. In exemplary embodiments, the cooling passages 142 may be formed via shaped tube electrolytic machining. Alternately, the cooling passages 142 may be formed in any suitable manner.

Figure 5:
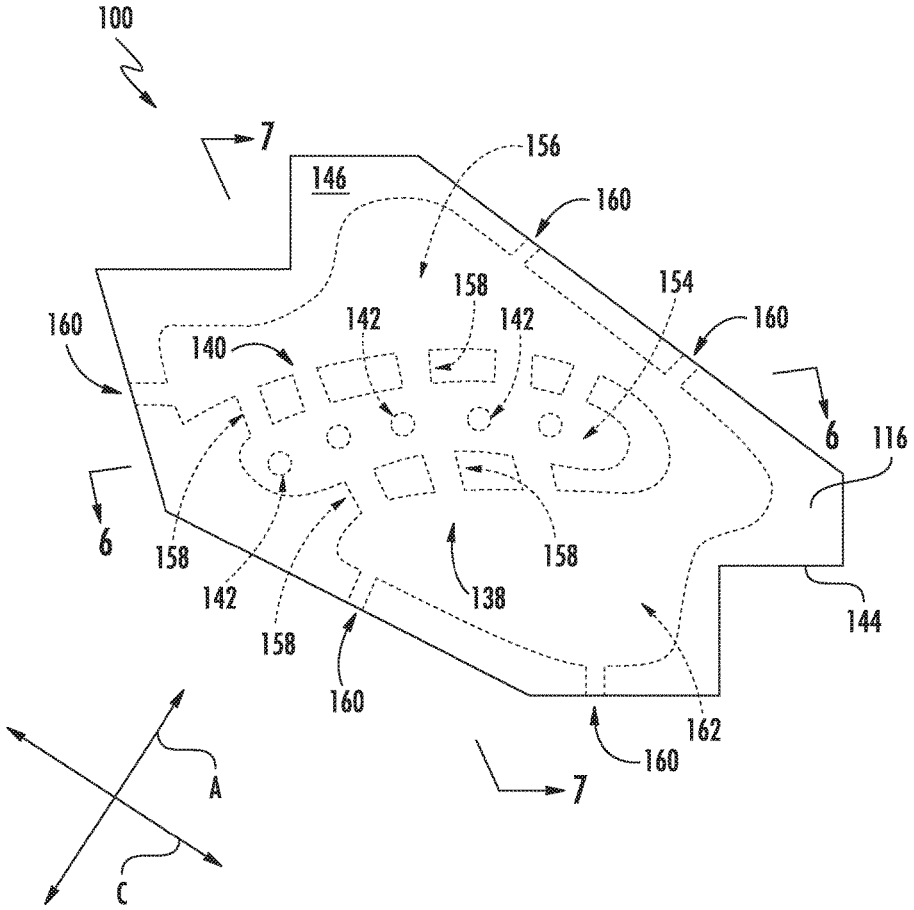
FIG. 5 is a top view of the rotor blade in accordance with the embodiments disclosed herein.
Figure 7:
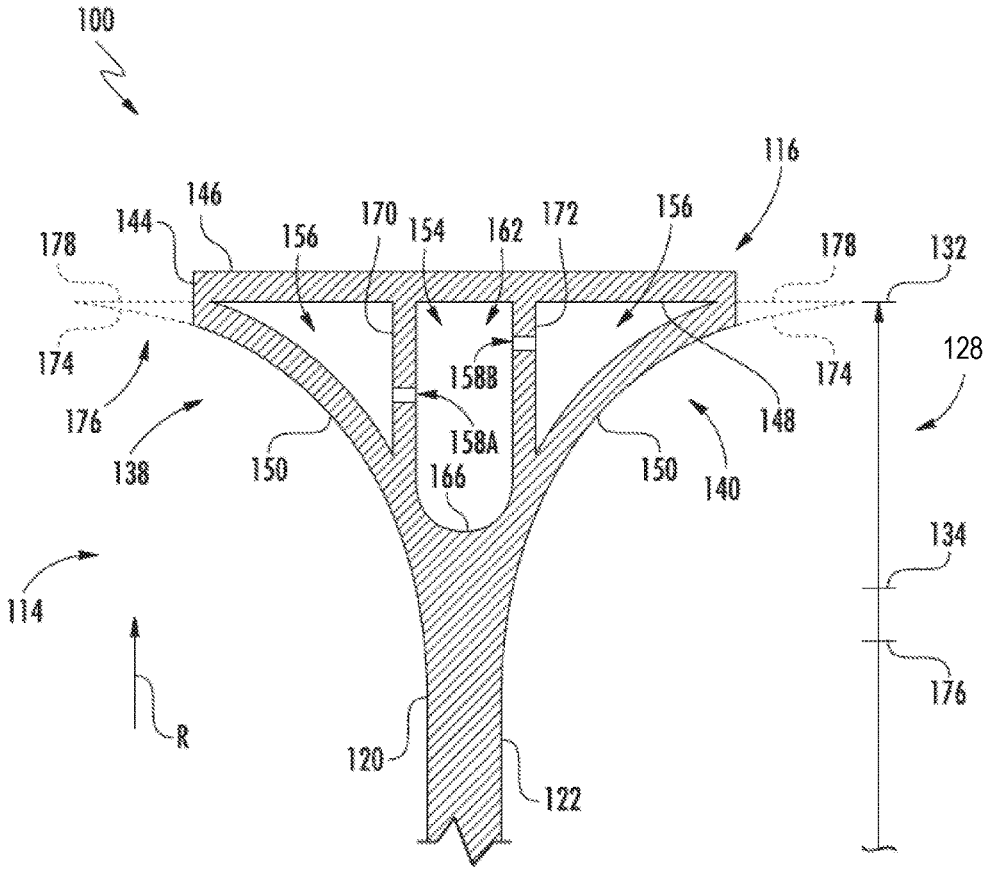
FIG. 7 is a cross-sectional view of the rotor blade taken generally about line 7-7 in FIG. 5 in accordance with the embodiments disclosed herein.

As mentioned above, the rotor blade 100 includes the tip shroud 116. As illustrated in FIGS. 2 and 5, the tip shroud 116 couples to the radially outer end of the airfoil 114 and generally defines the radially outermost portion of the rotor blade 100. In this respect, the tip shroud 116 reduces the amount of the combustion gases 34 (FIG. 1) that escape past the rotor blade 100. The tip shroud 116 includes a side surface 144, a radially outer surface 146, and a radially inner surface 148 (FIG. 7). As will be discussed in greater detail below, a fillet 150 may transition between the radially inner surface 148 of the tip shroud 116 and the pressure and suction side surfaces 120, 122 of the airfoil 114. In some embodiments (not shown), the tip shroud 116 includes a single seal rail extending radially outwardly from the radially outer surface 146. Alternate embodiments, however, may include more than one seal rail (e.g., two seal rails, three seal rails, etc.) or no seal rails at all.

Referring particularly to FIG. 5, the tip shroud 116 defines various passages, chambers, and apertures to facilitate cooling thereof. As shown, the tip shroud 116 defines a central plenum 154. In the embodiment shown, the central plenum 154 is fluidly coupled to the cooling passages 142. The tip shroud 116 also defines a main body cavity 156. One or more cross-over apertures 158 defined by the tip shroud 116 may fluidly couple the central plenum 154 to the main body cavity 156. Furthermore, the tip shroud 116 defines one or more outlet apertures 160 that fluidly couple the main body cavity 156 to the hot gas path 32 (FIG. 1). In the embodiment shown in FIG. 5, the tip shroud 116 defines eight cross-over apertures 158 and five outlet apertures 160. In alternate embodiments, however, the tip shroud 116 may define more or fewer cross-over apertures 158 and/or outlet apertures 160. Moreover, the tip shroud 116 may define any suitable configuration of passages, chambers, and/or apertures. The central plenum 154, the main body cavity 156, the cross-over apertures 158, and the outlet apertures 160 may collectively be referred to as a core 162.

During operation of the gas turbine engine 10 (FIG. 1), cooling fluid flows through the passages, cavities, and apertures described above to cool the tip shroud 116. More specifically, cooling fluid (e.g., bleed air from the compressor section 14) enters the rotor blade 100 through the intake port 112 (FIG. 2). At least a portion of this cooling flows through the cooling passages 142 and into the central plenum 154 in the tip shroud 116. The cooling fluid then flows from the central plenum 154 through the cross-over apertures 158 into main body cavity 156. While flowing through the main body cavity 156, the cooling fluid convectively cools the various walls of the tip shroud 116. The cooling fluid may then exit the main body cavity 156 through the outlet apertures 160 and flow into the hot gas path 32 (FIG. 1).

Figure 6:
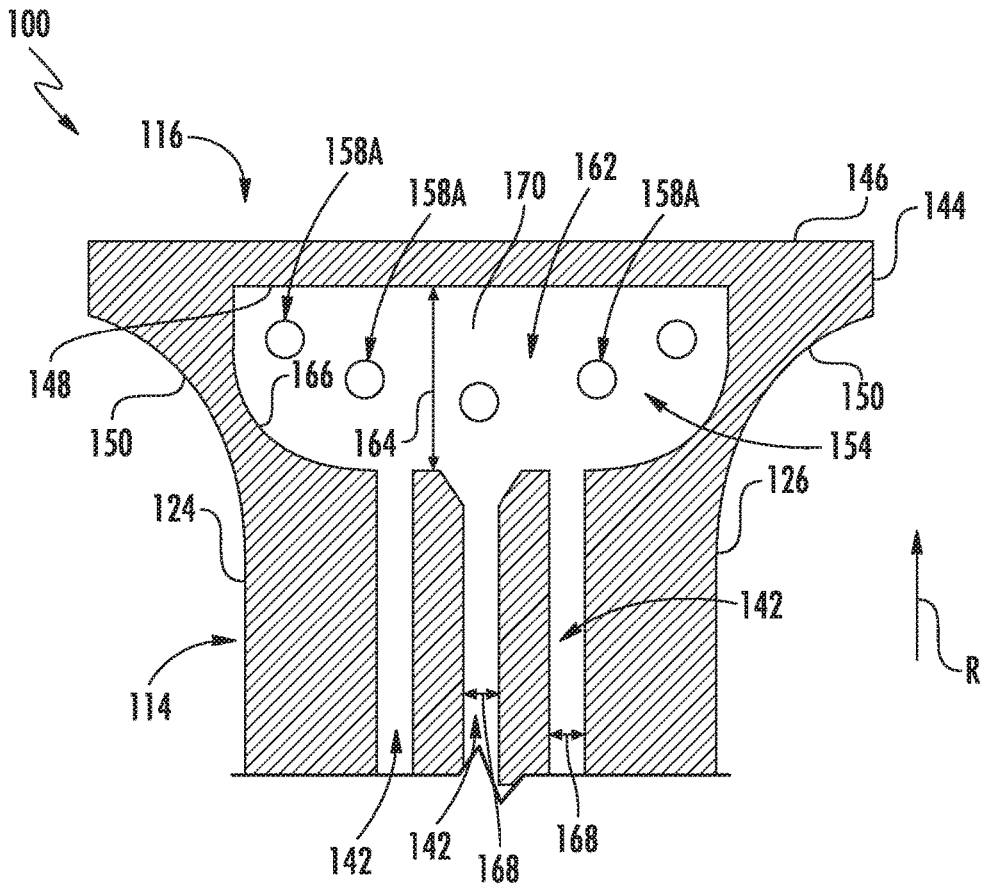
FIG. 6 is a cross-sectional view of the rotor blade taken generally about line 6-6 in FIG. 5 in accordance with the embodiments disclosed herein.

As illustrated in FIG. 6, the core 162 includes a maximum depth 164. More specifically, the maximum depth 164 may extend in the radial direction R, such as from the radially inner surface 148 of the tip shroud 116 to a radially inner surface 166 of the core 162. As shown, the radially inner surface 166 of the core 162 may have an arcuate cross-section. Alternately, the radially inner surface 166 of the core 162 may have a triangular cross-section, a flat cross-section, or any other suitable configuration. In particular embodiments, the maximum depth 164 of the core 162 may be located in the central plenum 154 and proximate to the cooling passages 142. Alternately, the maximum depth 164 may be located in any portion of the core 162 proximate to the cooling passages 142.

The maximum depth 164 of the core 162 may be a function of a minimum hydraulic diameter 168 of the largest cooling passage 142 (i.e., the cooling passage 142 exhibiting the largest minimum hydraulic diameter). In some embodiments, the maximum depth 164 of the core 162 may be at least six times greater than the minimum hydraulic diameter 168 of the largest cooling passage 142. In other embodiments, the maximum depth 164 of the core 162 may be at least nine times greater than the minimum hydraulic diameter 168 of the largest cooling passage 142. Nevertheless, the maximum depth 164 of the core 162 may have suitable size relative to the minimum hydraulic diameter 168 of the largest cooling passage 142.

As mentioned above, the cooling passages 142 may be formed via shaped tube electrolytic manufacturing. During this process, an electrolyte (not shown) may splash out of the cooling passage 142 being formed. In conventional configurations, the maximum depth of the core is generally much less than six times greater than the maximum diameter of the cooling passages. In such configurations, the electrolyte may contact and arc on the tip shroud, thereby undesirably and unintentionally removing material therefrom. This may require expensive and time consuming repairs, which increase the overall cost of manufacturing conventional rotor blades. As discussed above, however, the maximum depth 164 of the core 162 is at least six times greater than the minimum hydraulic diameter 168 of the largest cooling passages 142. In this respect, any electrolyte that splashes out of the cooling passages 142 does not contact the tip shroud 116. As such, material is not undesirably and unintentionally removed from the tip shroud 116. Accordingly, expensive and time consuming repairs are unnecessary and the overall cost of manufacturing the rotor blades 100 is less than that of conventional rotor blades.

Figure 8:
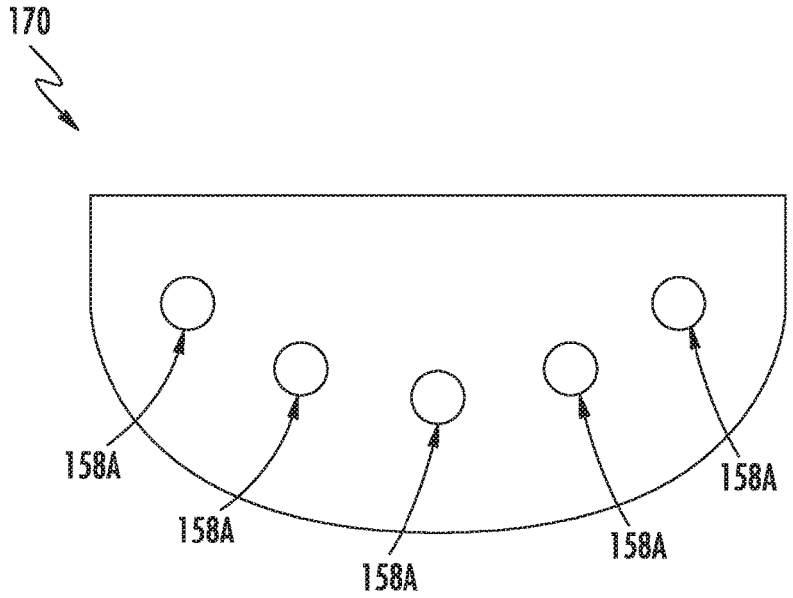
FIG. 8 is a front view of a first rib in accordance with the embodiments disclosed herein.

Referring now to FIGS. 6-8, the cross-over apertures 158 may be defined by one or more ribs 170, 172 positioned within the airfoil 114 and/or the tip shroud 116. In particular, the ribs 170, 172 may separate one portion of the core 162 (e.g., the central plenum 154) from another portion of the core 162 (e.g., the main body cavity 156). As such, the rib 170 may define a first set of cross-over apertures 158A, and the rib 172 may define a second set of cross-over apertures 158B. As shown, the first set of cross-over apertures 158A may be at least partially positioned radially inward of the second set of cross-over apertures 158B.

Referring now to FIGS. 6 and 8 at least some of the cross-over apertures 158A, 158B may be arranged in a non-linear pattern, such as an arcuate pattern. The first set of cross-over apertures 158A may be arranged in an arcuate pattern. In alternate embodiments, the cross-over apertures 158A, 158B may be arranged in any suitable manner. For example, all of the cross-over apertures 158A, 158B may be aligned at a radial distance except for one cross-over aperture 158A, 158B, which is radially spaced apart from the other cross-over apertures 158A, 158B.

The arcuate pattern of the cross-over apertures 158A, 158B facilitates a longer service life for the rotor blade 100 than conventional rotor blades. More specifically, the radially outer surface 146 of the tip shroud 116 is typically one of the hottest portions of the rotor blade. In conventional rotor blades, the cross-over apertures are generally arranged in a linear manner. That is, all of the cross-over apertures are positioned the same radial distance from the radially outer surface of tip shroud. In this respect, all of the cross-over apertures are positioned in close proximity to the radially outer surface of tip shroud. The close proximity of apertures (i.e., the cross-over apertures) to the radially outer surface of tip shroud reduces the service life of the rotor blade. Conversely, the arcuate pattern of the cross-over apertures 158A, 158B permits at least some of the cross-over apertures 158A, 158B to be moved radially inward from the radially outer surface 146 of the tip shroud 116. In this respect, the rotor blade 100 include fewer apertures positioned in close proximity of the radially outer surface 146 of the tip shroud 116 than in conventional rotor blades. As such, the rotor blade 100 has a longer service life than the conventional rotor blades.

As mentioned above, the fillet 150 transitions between the airfoil 114 and the tip shroud 116. In this respect, the airfoil 114 and the tip shroud 116 collectively define the fillet 150. As illustrated in FIG. 7, the fillet 150 includes a runout 176. In particular, the runout of the fillet 150 occurs where a radius 174 of the fillet 150 intersects the airfoil 114 or the tip shroud 116. In some embodiments, the runout 176 of the fillet 150 occurs radially inward from ninety percent 134 of the span 128 and is identified by 176. That is, the fillet 150 intersects the airfoil 114 below ninety percent 134 of the span 128. The runout 176 of the fillet 150 may also be beyond the side surface 144 of the tip shroud 116. In this respect, the radius 174 of the fillet 150 does not intersect the tip shroud 116. That is, the radius 174 of the fillet 150 intersects a line 178 corresponding to the radial position of the tip shroud 116 at a position outward from (i.e., beyond) the side surface 144. In some embodiments, the runout 176 of the fillet 150 may be radially inward from ninety percent 134 of the span 128, beyond the side surface 144 of the tip shroud 116 at least one location, or both radially inward from ninety percent 134 of the span 128 and beyond the side surface 144 of the tip shroud 116 at least one location.

The runout 176 of the fillet 150 discussed above may facilitate a longer service life for the rotor blade 100 compared to conventional rotor blades. More specifically, the fillet between the airfoil and the tip shroud is typically the portion of the rotor blade subjected to the greatest stress. By extending the runout of the fillet 150 below ninety percent 134 of the span 128 and/or beyond the side surface 144 of the tip shroud 116, the fillet 150 is larger than conventional fillets. The larger fillet 150 is able to better resist stress than the smaller conventional fillets. As such, the rotor blade 100 having the fillet 150 has a longer service life than conventional rotor blades having conventional fillets. This longer service life outweighs the reduced aerodynamic efficiency caused by the fillet 150. Furthermore, the fillet 150 may enable other features of the rotor blade 100 such as the core 162 having the maximum depth 164 of at least six times the minimum hydraulic diameter 168 of the cooling passages 142 and/or the arcuate arrangement of cross-over apertures 158.

Various features disclosed herein may be combined into a single embodiment of the rotor blade 100. In one embodiment, for example, the rotor blade 100 may include the core 162 having the maximum depth 164 of at least six times the minimum hydraulic diameter 168 of the cooling passages 142 and the fillet 150 having the runout thereof extending beyond the side surface 144 of the tip shroud 116 or below ninety percent 134 of the span 128. In another embodiment, the rotor blade 100 may include the core 162 having the maximum depth 164 of at least six times the minimum hydraulic diameter 168 of the cooling passages 142 and at least some cross-over apertures 158 arranged in an arcuate pattern. In a further embodiment, the rotor blade 100 may include the fillet 150 having the runout thereof extending beyond the side surface 144 of the tip shroud 116 or below ninety percent 134 of the span 128 and at least some cross-over apertures 158 arranged in an arcuate pattern. In another embodiment, the rotor blade 100 may include the core 162 having the maximum depth 164 of at least six times the minimum hydraulic diameter 168 of the cooling passages 142, the fillet 150 having the runout thereof extending beyond the side surface 144 of the tip shroud 116 or below ninety percent 134 of the span 128, and at least some cross-over apertures 158 arranged in an arcuate pattern. Alternately, the rotor blade 100 may include only one of the aforementioned features.

Figure 9:
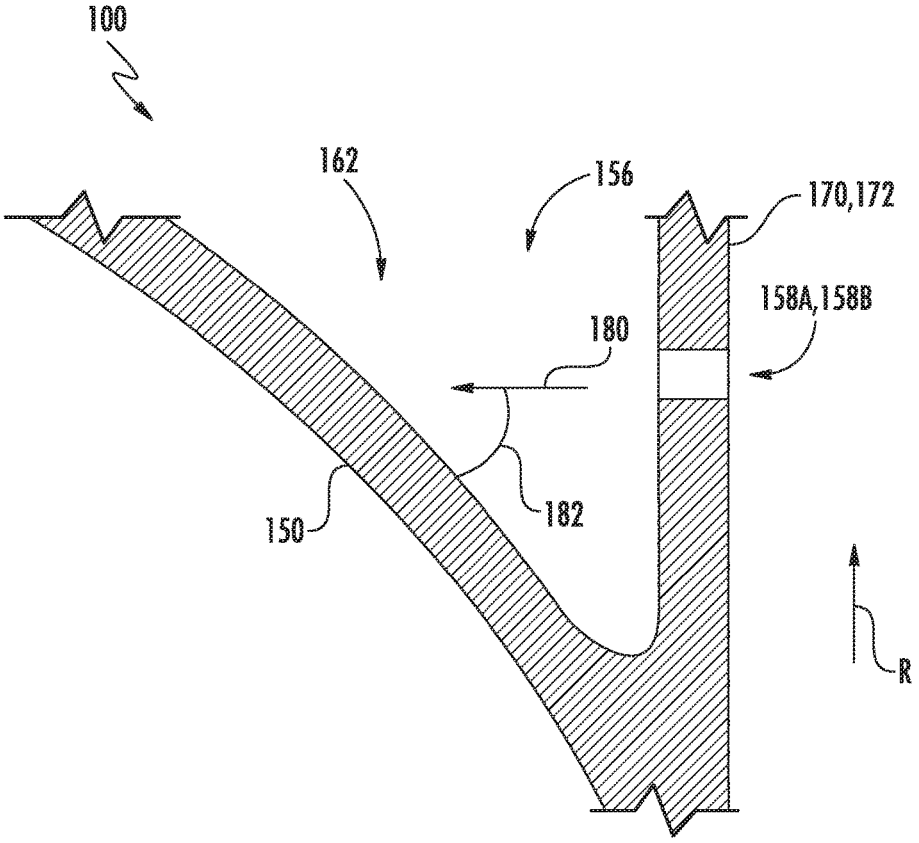
FIG. 9 is an enlarged cross-sectional view of a cross-over aperture, illustrating an angle of incidence in accordance with the embodiments disclosed herein.

Combining two or more of the aforementioned features may provide additional benefits. For example, combining the core 162 having the maximum depth 164 of at least six times the minimum hydraulic diameter 168 of the cooling passages 142 and the fillet 150 having the runout thereof extending beyond the side surface 144 of the tip shroud 116 or below ninety percent 134 of the span 128 may result in improved cooling of the fillet 150. As illustrated in FIG. 9, the larger fillet 150 and deeper core 162 (i.e., compared to conventional fillets and cooling cavities) permits the cross-over apertures 158A, 158B to being positioned radially inward from conventional cross-over apertures. As such, the cross-over apertures 158A, 158B may direct cooling fluid identified by arrow 180 onto the fillet 150 at an angle of incidence 182 between thirty degrees and ninety degrees. Conventional arrangements have an angle of incidence of substantially less than thirty degrees. The closer the angle of incidence is to ninety degrees, the greater the convective heat transfer provided by the cooling fluid. In this respect, the rotor blade 100 provides improved impingement cooling to the fillet 150 compared to conventional rotor blades.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade for a turbomachine, the rotor blade comprising:

an airfoil defining a leading edge, a trailing edge opposite the leading edge, and at least one cooling passage extending in a radial direction; and a tip shroud coupled to the airfoil, the tip shroud having a radially inner shroud surface;

a core defined between the radially inner shroud surface of the tip shroud and the airfoil, the core comprising a core surface and a central plenum fluidly coupled to the at least one cooling passage;

a first rib extending radially between the core surface and the radially inner shroud surface and axially between the leading edge and the trailing edge, the first rib defining therethrough a first plurality of cross-over apertures;

wherein a maximum radial depth of the core is at least six times greater than a minimum hydraulic diameter of a largest cooling passage of the at least one cooling passage; and wherein the first rib comprises a first linear edge proximate the radially inner shroud surface and a first arcuate edge connected to each end of the first linear edge, the first arcuate edge being disposed in an axial direction, the first plurality of cross-over apertures including a first cross-over aperture and a second cross-over aperture, the remaining cross-over apertures of the first plurality of cross-over apertures being disposed in an arcuate, continuously concave pattern in the radial direction between the first cross-over aperture and the second cross-over aperture corresponding to a first arcuate shape of the first arcuate edge.

2. The rotor blade of claim 1, further comprising a second rib axially spaced from the first rib, the first rib and the second rib defining the central plenum; wherein a main body cavity is defined axially outboard of the central plenum, the second rib defining a second plurality of cross-over apertures fluidly coupling the central plenum and the main body cavity; and wherein the second plurality of cross-over apertures is arranged in a non-linear pattern.

3. The rotor blade of claim 1, wherein the airfoil comprises a span extending from a root of the airfoil to the tip shroud; wherein the tip shroud comprises a side surface; and wherein the tip shroud and the airfoil collectively define a fillet having a radius of curvature, a first end of the fillet intersecting the airfoil at a runout point radially inward of ninety percent of the span, as measured in the radial direction from the root.

4. The rotor blade of claim 3, wherein the radius of curvature of the fillet includes a second end that extends beyond the side surface of the tip shroud to intersect with a radial plane defined by the tip shroud.

5. The rotor blade of claim 1, wherein the at least one cooling passage is formed via shaped tube electrolytic machining.

6. A rotor blade for a turbomachine, the rotor blade comprising:

an airfoil having a leading edge and a trailing edge;

a tip shroud coupled to the airfoil, the tip shroud and the airfoil at least partially defining a main body cavity and a central plenum therebetween;

a first rib separating the main body cavity and the central plenum and extending radially between a core surface of the central plenum and a radially inner surface of the tip shroud, the first rib defining a first plurality of cross-over apertures fluidly coupling the central plenum and the main body cavity;

wherein the first plurality of cross-over apertures includes a first cross-over aperture and a second cross-over aperture, the remaining cross-over apertures of the first plurality of cross-over apertures being disposed in an arcuate, continuously concave pattern in the radial direction between the first cross-over aperture and the second cross-over aperture.

7. The rotor blade of claim 6, wherein the tip shroud includes a second rib axially spaced from the first rib, the first rib and the second rib at least partially defining the central plenum; wherein the second rib defines a second plurality of cross-over apertures fluidly coupling the central plenum and the main body cavity.

8. The rotor blade of claim 7, wherein the airfoil defines a camber line extending from a leading edge to a trailing edge, and wherein the first plurality of cross-over apertures is positioned on a pressure side of the camber line and the second plurality of cross-over apertures is positioned on a suction side of the camber line.

9. The rotor blade of claim 6, wherein the airfoil defines at least one cooling passage fluidly coupled to the central plenum, and wherein a maximum radial depth of the central plenum is at least six times greater than a minimum hydraulic diameter of the at least one cooling passage.

10. The rotor blade of claim 6, wherein the airfoil comprises a span extending from a root of the airfoil to the tip shroud; wherein the tip shroud comprises a side surface; and wherein the tip shroud and the airfoil collectively define a fillet having a radius of curvature, a first end of the fillet intersecting the airfoil at a first runout point radially inward of ninety percent of the span, as measured in a radial direction from the root.

11. A rotor blade for a turbomachine, the rotor blade comprising:

a root;

an airfoil defining a span extending from the root of the airfoil to a tip shroud;

the tip shroud coupled to the airfoil, the tip shroud including a side surface, the tip shroud and the airfoil at least partially defining a central plenum and a main body cavity; and a first rib extending radially from a core surface of the central plenum to a radially inner surface of the tip shroud, the first rib defining a plurality of cross-over apertures fluidly coupling the central plenum and the main body cavity, the plurality of cross-over apertures including a first cross-over aperture and a second cross-over aperture, the remaining cross-over apertures of the plurality of cross-over apertures disposed in an arcuate, continuously concave pattern in the radial direction between the first cross-over aperture and the second cross-over aperture, wherein the tip shroud and the airfoil collectively define a fillet, the fillet having a radius of curvature, a first end of the fillet intersecting the airfoil at a first runout point radially inward of ninety percent of the span as measured in a radial direction from the root.

12. The rotor blade of claim 11, wherein a second end of the radius of curvature of the fillet extends beyond the side surface of the tip shroud to intersect at a second runout point with a radial plane defined by the tip shroud.

13. The rotor blade of claim 11, wherein the plurality of cross-over apertures directs cooling fluid at the fillet to convectively cool the fillet.

14. The rotor blade of claim 13, wherein the plurality of cross-over apertures directs cooling fluid at the fillet at an angle of incidence of between thirty degrees and ninety degrees.

15. The rotor blade of claim 11, wherein the first rib comprises an arcuate edge adjacent the core surface; and wherein a first cross-over aperture of the plurality of cross-over apertures is disposed at a first radial distance from the radially inner surface of the tip shroud, and a second cross-over aperture of the plurality of cross-over apertures is disposed at a second radial distance from the radially inner surface of the tip shroud, the first radial distance being different from the second radial distance.

16. The rotor blade of claim 11, wherein the airfoil defines at least one cooling passage fluidly coupled to the central plenum, and wherein a maximum radial depth of the central plenum is at least six times greater than a minimum hydraulic diameter of the at least one cooling passage.

* * * * *